US008807287B2

(12) United States Patent
Li

(10) Patent No.: US 8,807,287 B2
(45) Date of Patent: Aug. 19, 2014

(54) ELEVATOR OPERATION PLATE

(71) Applicant: Ming Li, Xiamen (CN)

(72) Inventor: Ming Li, Xiamen (CN)

( * ) Notice: Subject to any disclaimer, the term of this patent is extended or adjusted under 35 U.S.C. 154(b) by 78 days.

(21) Appl. No.: 13/651,261

(22) Filed: Oct. 12, 2012

(65) Prior Publication Data

US 2014/0102832 A1 Apr. 17, 2014

(30) Foreign Application Priority Data

Nov. 10, 2011 (CN) ..... 2011 2 0441627

(51) Int. Cl.
*B66B 1/34* (2006.01)

(52) U.S. Cl.
USPC ..... 187/395; 187/391

(58) Field of Classification Search
CPC ..... B66B 11/0226; B66B 11/0233; B66B 11/0253; B66B 2201/46; B66B 2201/4607; B66B 2201/4615; B66B 1/14
USPC ..... 187/247, 391–399
See application file for complete search history.

(56) References Cited

U.S. PATENT DOCUMENTS

| | | | | | |
|---|---|---|---|---|---|
| 5,679,934 | A * | 10/1997 | Juntunen et al. | ..... | 187/395 |
| 6,105,729 | A * | 8/2000 | Nakamori et al. | ..... | 187/391 |
| 6,161,654 | A * | 12/2000 | Sirigu et al. | ..... | 187/391 |
| 6,227,335 | B1 * | 5/2001 | Koeppe et al. | ..... | 187/414 |
| 6,502,668 | B1 * | 1/2003 | Chida et al. | ..... | 187/395 |
| 7,021,428 | B2 * | 4/2006 | Han et al. | ..... | 187/395 |
| 7,040,458 | B2 * | 5/2006 | Forsythe et al. | ..... | 187/396 |
| 7,281,610 | B2 * | 10/2007 | Ylinen et al. | ..... | 187/382 |
| 7,318,501 | B2 * | 1/2008 | Felder | ..... | 187/414 |
| 7,398,865 | B2 * | 7/2008 | Felder et al. | ..... | 187/395 |
| 7,404,470 | B2 * | 7/2008 | Felder et al. | ..... | 187/395 |
| 8,136,636 | B2 * | 3/2012 | Bahjat et al. | ..... | 187/391 |
| 8,336,678 | B2 * | 12/2012 | Poutiainen et al. | ..... | 187/395 |
| 8,348,022 | B2 * | 1/2013 | Rusanen et al. | ..... | 187/395 |
| 8,370,158 | B2 * | 2/2013 | Gazdzinski | ..... | 704/270 |
| 2011/0043385 | A1 * | 2/2011 | Zhao et al. | ..... | 341/22 |
| 2011/0080345 | A1 * | 4/2011 | Jun et al. | ..... | 345/169 |
| 2011/0284330 | A1 * | 11/2011 | Massameno | ..... | 187/391 |

* cited by examiner

*Primary Examiner* — Anthony Salata

(57) ABSTRACT

The present invention discloses a universal elevator operation plate to overcome the problems of the existing operation plate which is provided with floor buttons corresponding to the number of the floors of a building. The elevator operation plate of the present invention uses floor election buttons to show the numeric "0-9", a clear button, a floor confirmation button, and a number/letter switch button to achieve floor election operation to indicate the floor by number or letter. The present invention can be produced in standardization to lower the cost.

2 Claims, 2 Drawing Sheets

ELEVATOR OPERATION PLATE

BACKGROUND OF THE INVENTION

1. Field of the Invention

The present invention relates to an elevator operation plate, and more particularly to an elevator operation plate of universal functions which can be produced in standardization.

2. Description of the Prior Art

A conventional elevator operation plate is provided with a plurality of floor buttons corresponding to the number of the floors of a building. The user presses a desired floor button and then the floor button is bright. This means the floor is elected successfully. The shortcoming is that the operation plate is large in size. It is required to have the operation plate custom-made. The operation plate cannot be produced in standardization. After election, only the elected floor button is bright so it is not clear for observation. The production cost is high and the period of production is long. It is easy to maintain and replace the parts. Accordingly, the inventor of the present invention has devoted himself based on his many years of practical experiences to solve this problem.

SUMMARY OF THE INVENTION

The primary object of the present invention is to provide an elevator operation plate of universal functions to overcome the problems of the existing operation plate which is provided with floor buttons corresponding to the number of the floors of a building. The elevator operation plate of the present invention uses the floor election buttons to show the numeric "0-9", the clear button, the floor confirmation button, and the number/letter switch button to achieve floor election operation to indicate the floor by number or letter. The present invention can be produced in standardization to lower the cost.

The elevator operation plate of the present invention comprises a panel. The panel comprises a function button unit, a display screen and a floor election module thereon. The function button unit comprises an alarm button, an emergency illumination lamp button and an intercom button. The floor election module comprises floor election buttons, a clear button, a floor confirmation button, and a number/letter switch button. The display screen is a screen corresponding to operation of the floor election module to show the elected floor information. The panel is provided with a brand and load data plate. The panel is made of colored stainless steel, tempered glass, stone, or other decorative panel material. The display screen is made of polystyrene plate, glass or touch screen. Each button is a micro button or a touch button. Each of the buttons, the display screen, the illumination lamp and a horn are connected with electric wires and data wires to achieve normal work of each function module.

The floor election module comprises the floor election buttons to show the numeric "0-9", the clear button, the floor confirmation button, and the number/letter switch button to show a desired number or letter to indicate the elected floor instead of the conventional elevator operation plate which is provided with a plurality of floor buttons to indicate the respective floors. The number or letter of the elected floor is shown on the display screen to indicate the elected floor of the elevator so that the passenger can see clearly. This conforms to the demand of use for identification of all floors of the building and can be produced in standardization. The elevator operation plate can be widely used for various elevators with a control room or without a control room or with a hydraulic pressure design, and the number of the floors is not limited.

The main difference between the universal elevator operation plate and the conventional operation plate is the design and operation of the elected floor. No matter which floor is elected, the user just press the buttons to elect the desired floor and then press the confirmation button. The floor is elected successfully and displayed on the display screen in order. If the user wants to cancel the wrong operation, he/she just presses the clear button. If the clear button is pressed for long, all the elected floors can be cancelled in order, preventing devilment operation. If the passenger wants to go to the eighth floor, he/she first presses the numeric "8" button and then presses the confirmation button. The numeric "8" twinkles and then shows on the display screen to indicate that the eighth floor is elected successfully. Similarly, the number/letter button can be switched to achieve election of B1, E5 or the like.

Compared to the prior art, the present invention can be applied to all kinds of elevators. The elevator operation plate can be produced in standardization and in a large scale to lower the cost and to shorten the production time. The failure rate is decreased, and the maintenance can be done quickly.

DETAILED DESCRIPTION OF THE PREFERRED EMBODIMENTS

Embodiments of the present invention will now be described, by way of example only, with reference to the accompanying drawings.

Figure 1:
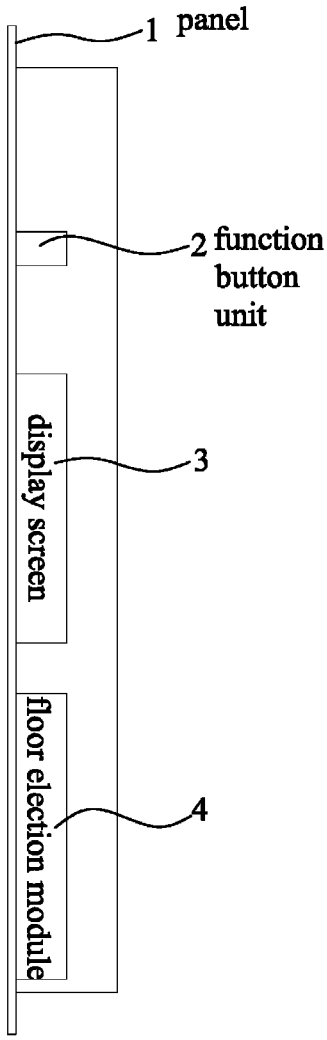
FIG. 1 is a schematic view according to a preferred embodiment of the present invention.
Figure 2:
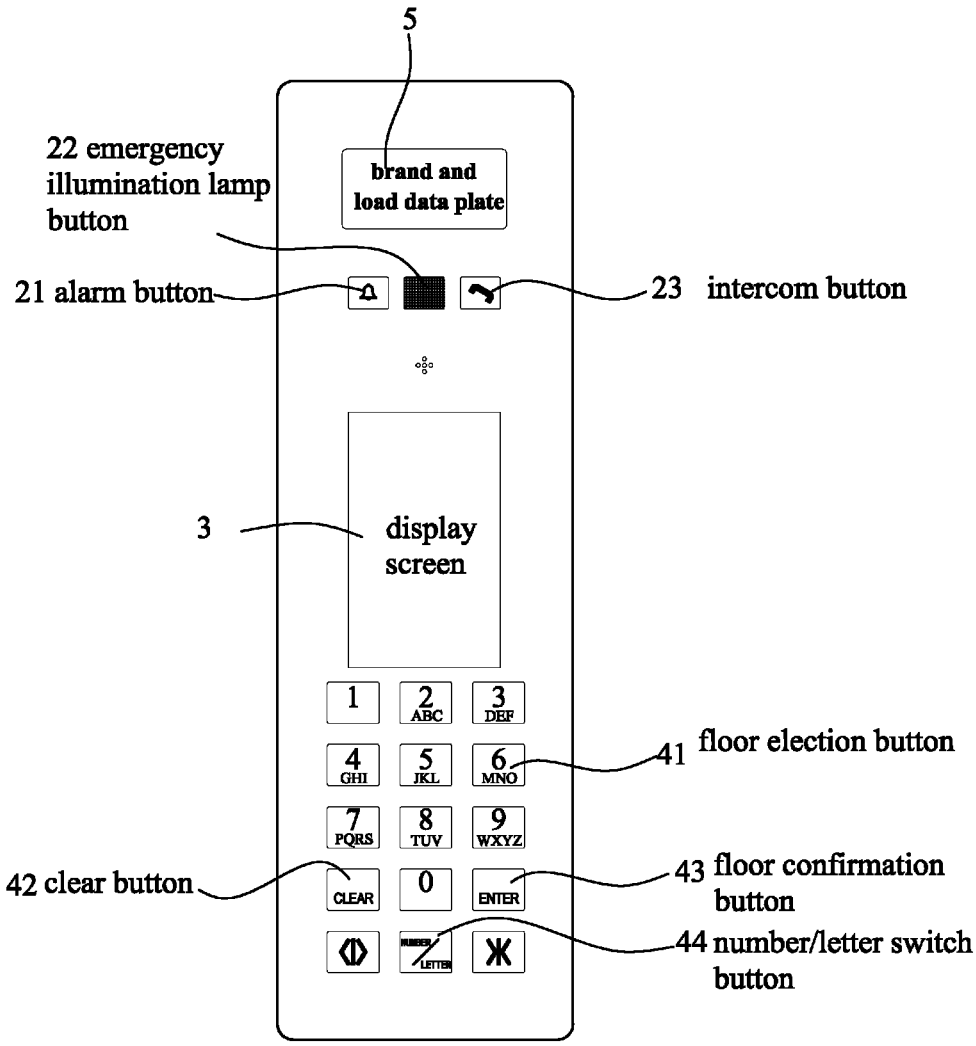
FIG. 2 is a right side view of FIG. 1.

As shown in FIG. 1 and FIG. 2, the elevator operation plate according to a preferred embodiment of the present invention comprises a panel (1). The panel (1) comprises a function button unit (2), a display screen (3) and a floor election module (4) thereon. The function button unit (2) comprises an alarm button (21), an emergency illumination lamp button (22) and an intercom button (23). The floor election module (4) comprises floor election buttons (41), a clear button (42), a floor confirmation button (43), and a number/letter switch button (44). The display screen (3) is a screen corresponding to operation of the floor election module (4) to show the floor information. The panel (1) is provided with a brand and load data plate (5). The panel (1) is made of colored stainless steel, tempered glass, stone, or other decorative panel material. The display screen (3) is made of polystyrene plate, glass or touch screen. Each button is a micro button or a touch button. Each of the buttons, the display screen, an illumination lamp and a horn are connected with electric wires and data wires to achieve normal work of each function module.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An elevator operation plate, comprising a panel (1), comprising a function button unit (2), comprising an alarm button (21), an emergency illumination lamp button (22) and an intercom button (23), a display screen (3), and a floor election module (4) comprising 15 buttons of a same size disposed in three rows, row 1 to row 3, and five columns, column 1 to 5, further including 10 floor election buttons (41), disposed in the row 1 to row 3 and the column 1 to column 3, as well as in the row 4 and column 2, and at least 8 of the 10 floor election buttons (41) being controlled to generate an alphanumeric combination in the display screen (3) when activated with one or more of the at least 8 out 10 floor election buttons (41) pressed down, wherein the alphanumeric combination is defined as a combination of any number of numbers of 0 to 9 and any number of alphabets from 'A' to 'Z';

a clear button (42), activated to remove from the display screen (3) one or more of the numbers of 0 to 9 or the alphabets of 'A' to 'Z' in the alphanumeric combination, a floor confirmation button (43) and a number/letter switch button (44) as a toggle to switch between the numbers of 0 to 9 and the alphabets of 'A' to 'Z', the display screen (3) being a screen corresponding to operation of the floor election module (4) to display the alpha-numerical combination as a result of activation of the floor election buttons (41), the clear button (42), or the number/letter switch button (44), followed by the floor confirmation button (43), and the panel (1) being provided with a brand and load data plate (5).

2. The elevator operation plate as claimed in claim 1, wherein the panel (1) is made of colored stainless steel, tempered glass, stone, or other decorative panel material, the display screen (3) being made of polystyrene plate, glass or touch screen, each button being a micro button or a touch button, each of the buttons, the display screen, an illumination lamp and a horn being connected with electric wires and data wires.

* * * * *